United States Patent [19]

Germershausen et al.

[11] 4,012,986

[45] Mar. 22, 1977

[54] VARIABLE-ELEVATION FIELD GUNS FOR MORTAR AND CANNON APPLICATIONS

[75] Inventors: Raimond Germershausen, Kaarst; Wilfried Becker, Duesseldorf, both of Germany

[73] Assignee: Rheinmetall G.m.b.H., Duesseldorf, Germany

[22] Filed: June 9, 1976

[21] Appl. No.: 694,235

[30] Foreign Application Priority Data

July 19, 1975 Germany ..... 2532354

[52] U.S. Cl. ..... 89/17; 89/1 J; 89/1.816; 89/37 C; 89/40 E; 89/44 R

[51] Int. Cl.[2] ..... F41F 21/12

[58] Field of Search ... 89/1 F, 1 J, 1.7, 1.704–1.706, 89/1.8, 1.816, 17, 37 R, 37 C, 40 E, 44 R

[56] References Cited

UNITED STATES PATENTS 1,461,561 7/1923 Romberg ..... 89/37 R 2,790,357 4/1957 Garrett ..... 89/37 C

*Primary Examiner*—Stephen C. Bentley

[57] ABSTRACT

An adjustable, easily erectable field piece settable at variable elevation angles is described. A two-point support is adapted to pivotally carry an intermediate member which is affixed to a composite sleeve serving as a barrel support member. A mortar breech mechanism is affixed to a first telescopic leg of the two-point support, and is pivotally mounted in a ground plate at such first base point to removably engage the rear end of the barrel when the barrel is at an upper elevation angle suitable for mortar application. A separate cannon breech mechanism is pivotally carried by the rear end of the barrel for selective firing engagement with the rear end of the barrel when such barrel is moved by the two-point support to a relatively low elevation angle suitable for cannon applications.

8 Claims, 3 Drawing Figures

VARIABLE-ELEVATION FIELD GUNS FOR MORTAR AND CANNON APPLICATIONS

BACKGROUND OF THE INVENTION

The invention relates to artillery field pieces and more particularly to variable-elevation field guns for selectable use in mortar and/or cannon applications.

A known type of such field piece, equipped with facilities for varying the elevation angle of the gun barrel, has been clumsy, bulky and hard to erect and manipulate, particularly in high-performance applications required by infantry task forces and the like. Because of these disadvantages, the effectiveness of such task forces in providing firing support for other units during operation against various types of targets is relatively low.

In addition, with such known arrangement, the type of ammunition which may be handled by a common breech mechanism coupled to the rear end of the barrel is necessarily limited.

SUMMARY OF THE INVENTION

Such disadvantages are overcome by the improved, highly flexible field gun arrangement constructed in accordance with the invention for adjustment between a relatively high elevation for mortar applications and a relatively low elevation for cannon applications.

In an illustrative embodiment, a barrel support member coaxial with and surrounding an intermediate portion of the field gun barrel is carried by a two-point adjustable support. A rear portion of such support, associated with a first base point, is connected to a mortar breech mechanism, which is pivotally seated in a ground plate at the first base point. Such mortar breech mechanism is adapted to removably engage the rear end of the barrel for firing mortar shells when the barrel is at its upper elevation angle.

For cannon applications, particularly for the firing of rocket shells, a separate cannon breech mechanism interchangeable with the above-mentioned mortar breech mechanism is pivotally carried at a rear portion of the barrel for oscillation through 180° in a plane containing the barrel axis and into an operative position in which the breech mechanism is engaged in firing relation with the rear end of the barrel when such barrel is moved by the two-point support into its lower elevation angle.

In order to facilitate rapid change-over of the elevation angle, the two-point support advantageously includes a front, bipod-like member whose lower end is pivotally supported at the other base point for oscillation in a vertical plane. The upper end of the bipod exhibits an axle separately supported for rotation in said plane, such axle being coupled to the front end of a levelling member to which the barrel support is affixed.

The other elements of the two-point support includes a telescoping member whose upper end is pivotally attached to the rear end of the levelling piece and whose lower end is affixed to the mortar breech mechanism. By suitable adjustment of the elevation of the bipod and the telescopic position of the upper end of the rear member of the two-point support, the inclination of the levelling member, and thereby the barrel support, can be easily adjusted.

In order to accommodate and measure the separate reaction forces generated when the field gun is individually employed in its mortar and cannon positions, the barrel support member may include a multi-sleeve assembly including an inner sleeve affixed to the outer periphery of the barrel and a shorter outer sleeve surrounding the inner sleeve and having a pair of inwardly extending end flanges which are straddled by a pair of outwardly extending end flanges on the inner sleeve. A glide member is adapted for axial displacement within the gap formed between the inner and outer sleeves, such glide member having a radially outwardly extending abutment which is captured within the chamber defined in the outer sleeve between its downwardly extending end flanges and its intervening main surface.

For high-elevation mortar applications employing the mortar breech mechanism, the glide member is shifted into its front-most position against the inner surface of the front flange on the inner sleeve. For cannon applications employing the other breech mechanism, the glide member is positioned against the rear flange of the inner sleeve. A pair of springs are individually disposed between the respective ends of the abutment and the inner surface of the adjacent flange on the outer sleeve, whereby the securing of the glide member in the front-most position serves to compress the front spring and expand the rear spring. Similarly, when the glide member is in its rear-most position, the rear spring is compressed and the front spring is expanded. The reaction movements of the abutment against the associated spring when a projectile is fired through the barrel can be easily measured as an indication of the reaction force of the barrel itself, since the glide member from which the abutment extends is locked to the inner sleeve and thereby to the barrel in the appropriate position when the barrel is moved into one or the other of its operative positions.

BRIEF DESCRIPTION OF THE DRAWING

The invention is further set forth in the following detailed description taken in conjunction with the appended drawing, in which.

DETAILED DESCRIPTION

Figure 1:
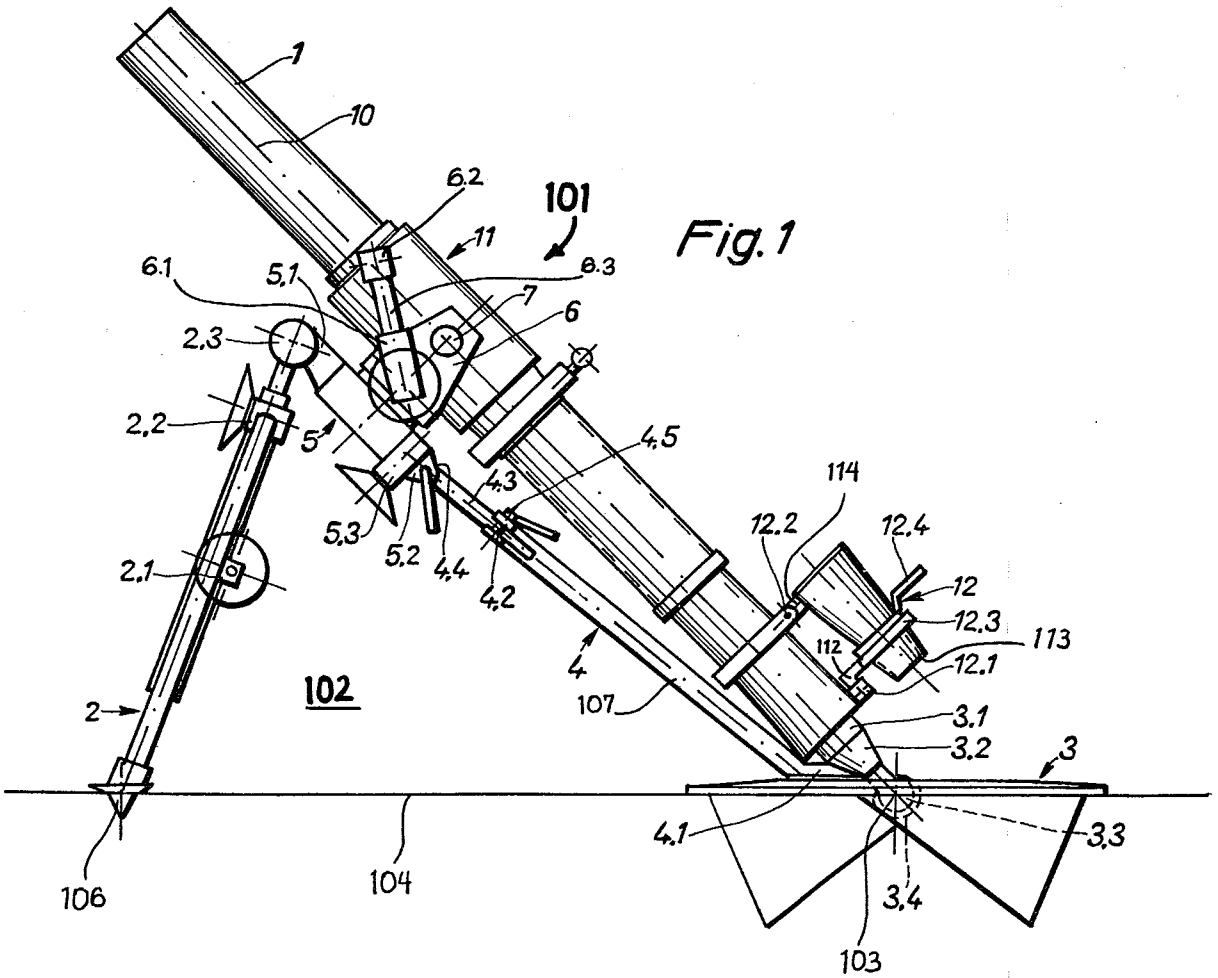
FIG. 1 is an elevational view of an adjustable mounting arrangement for a field gun in accordance with the invention when the barrel of the gun is elevated into a mortar firing position.

Referring now to the drawing, the numeral 101 represents an adjustable field piece suitable for infantry task force operations and characterized by its rapid convertibility from a mortar to a cannon and vice-versa. In particular, the field gun 101 includes an elongated barrel 1 which is carried by a surrounding barrel support member 11, which is described further in connection with FIG. 3. A longitudinal axis 10 of the barrel 1 is made adjustable, by means of a positioning assembly 102, between a relatively high elevation mortar position shown in FIG. 1 and a relatively low elevation cannon position shown in FIG. 2.

Figure 2:
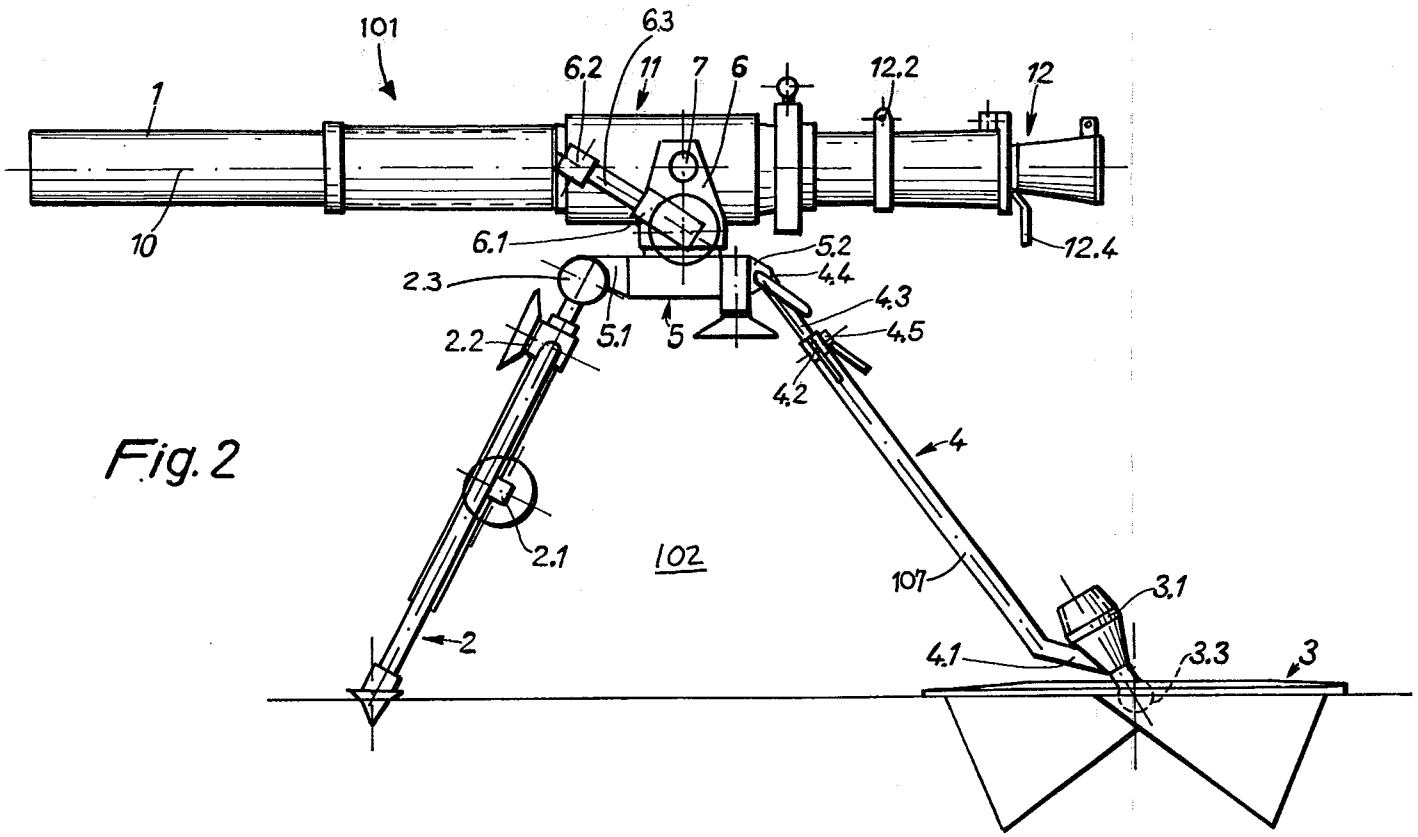
FIG. 2 is an elevational view of the mounting arrangement of FIG. 1 when the associated gun is aligned in a substantially horizontal position for cannon applications.

In addition, a pair of separate breech mechanisms 3.1 and 12 are interchangeably engageable with a rear end of the barrel for the separate firing of mortar shells when the barrel 1 is in the upper position and for the firing of rocket ammunition when the piece is set up as shown in FIG. 2.

For this purpose, the mortar breech mechanism 3.1 has an intermediate conical section 3.2 which is affixed to an offset lower end 4.1 of a rear support or coupling rod member 4 of the positioning assembly 102. The rear end of the conical portion 3.2 carries a ball-shaped extension 3.3, which is pivotally mounted in a spherical seat 3.4 of an anchor member or plate 3 which is disposed at a first base point 103 of the positioning assembly 102. Such base point 103 is illustratively shown as a point on a terrain represented at 104, although it will be understood that such base point 103, together with a second base point 106 located in spaced relation to the base point 103, may be disposed on the floor of a vehicle for mobile applications.

The positioning assembly 102 further includes a front support member 2, illustratively in the form of a bipod 2, having a two-legged lower end, both of said legs (only one of which is shown) terminating in the form of a ground spike which is pivotally carried at the second base point 106 as shown. The bipod 2 is adjustable in elevation via a suitable mechanism represented at 2.2, and carries at its upper end an axle 2.3 which is supported for oscillation in the plane of movement of the bipod. While not specifically illustrated, the rotation of the axle 2.3 about its axis may be power-assisted by means of a suitable drive. In addition, a cross-levelling drive 2.1 may be associated with the bipod 2 for aligning the bipod in a plane perpendicular to the plane of the drawing.

The coupling rod member 4 of the positioning assembly 102 includes a main section 107 having a longitudinally slotted upper end 4.2, the end 4.2 receiving an extension 4.3 in telescoping fashion so that the distance between the upper end of the extension 4.3 and the bottom end of the main section 107 can be varied. A hand-operated catch 4.5 is associated with the extension 4.3 and the slotted end 4.2 for removably locking the extension 4.3 in the desired position. In the mortar orientation shown in FIG. 1, the extension 4.3 is substantially retracted into the main section 107.

The positioning assembly 102 further includes an intermediate bridge or levelling member 5 which adjustably interconnects the upper end of the support members 2 and 4. For this purpose, a front end 5.1 of the bridge member 5 is affixed to the rotatable axle 2.3 at the upper end of the bipod 2, while a rear end 5.2 of the bridge member 5 is pivoted as at 4.4 with an upper end of the rear support rod extension 4.3.

In the position shown in FIG. 1, the bipod 2 has been elevated to a relatively high angle, while the axle 2.3 has been rotated so that the longitudinal axis of the bridge member 5 is inclined at an angle approximating the desired angle of elevation of the barrel axis 10 for mortar applications.

A barrel support receptacle 6 is fixedly carried at an intermediate portion of the bridge member 5 to mount the barrel support member 11 for elevational movement via a trunion 7. To additionally provide elevational adjustment capacity, a front end of a member 6.3 is pivotally carried in a seat 6.2 disposed at the front end of the barrel support 11, and is carried telescopically on its opposite end by a member 6.1 on the receptacle 6. If desired, adjustment of the receptacle 6 in a plane perpendicular to the drawing may be accomplished by conventional means including a traversing mechanism 5.3 on the bridge member 5.

The breech member 12 adapted for firing cannon or rocket ammunition when such mechanism 12.3 is engaged in firing relation with the rear of the barrel 1 in the manner depicted in FIG. 2 is normally carried, in its inoperative position shown in FIG. 1, on a pivot 12.1 disposed on a rear portion of the barrel 10. The pivot 12.1 receives the bent end of an L-shaped extension 112 that is affixed to a mounting ring 12.3, such ring being in turn secured to a rear end of the breech mechanism 12. The pivot 12.1 and the ring 12.3 with its extension 112 are adapted to permit the breech mechanism 12.3 to pivot through 180° in a plane containing the barrel axis 10 (e.g., in the plane of the drawing) from a front inoperative position in which a front end 113 of the breech member 12 is out of engagement with the rear end of the barrel and a rear operative position (shown in FIG. 2) in which the end 113 is in firing relation with the rear end of the barrel. In the inoperative position shown in FIG. 1, the breech mechanism 12 extends parallel to the barrel axis 10 and in spaced relation to the outer periphery of the barrel. In this position, a slotted holder 12.2 affixed to the barrel 10 receives an outwardly projecting lug 114 on the rear end of the breech mechanism 12 to stabilize the breech mechanism 12 in its inoperative position. A gripping member 12.4 extends from the mounting ring 12.3 in an outward direction to permit pivoting, by hand, of the breech mechanism 12 around the pivot point 12.1 at the rear portion of the barrel and into its operative firing position at the rear of the barrel 1.

FIG. 2 illustrates the position of the gun 101 when the positioning mechanism 102 has been adjusted to aim the barrel 1 into its level or cannon position. To accomplish this movement, the mortar breech mechanism 3.1 is first decoupled from the rear end of the barrel, and the cannon breech mechanism 12 is pivoted by 180° from the position shown in FIG. 1 to the position shown in FIG. 2. Also, the rear supporting coupling rod member 4 and the bipod 2 are adjusted so that the bridging member 5, and thereby the barrel support member 11 supported thereby, are level.

To accomplish the adjustment of the positioning mechanism 102, the hand-operated catch 4.5 on the rear support rod 5 is disengaged, and the extension piece 4.3 moved outward to pivot the axle 2.3, and thereby the front end of the bridging member 5, in a counter-clockwise direction until the bridging member is horizontal. At this point, the catch 4.5 may be re-engaged. (To aid in levelling the member 5, the mortar breech member 3.1, which is affixed to the rear supporting coupling rod member 4 may also be pivoted in its seat 3.4 as needed).

At this point, operation in the cannon mode may take place.

Figure 3:
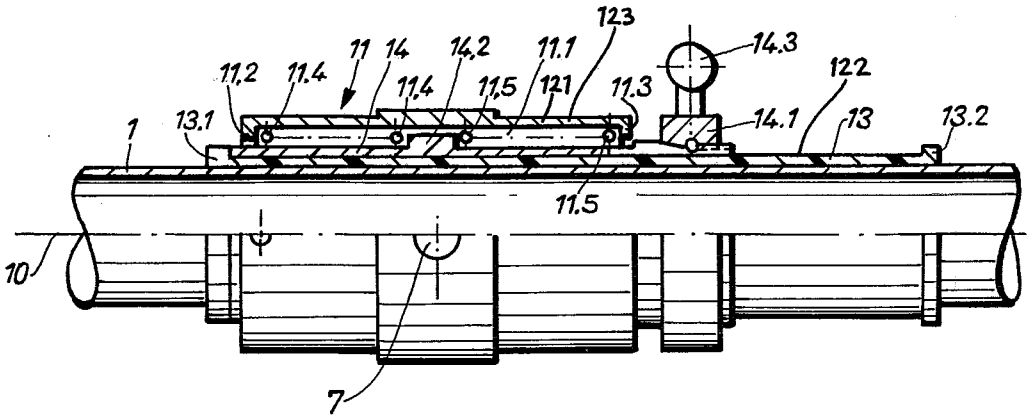
FIG. 3 is a fragmentary longitudinal view, partially in section, illustrating an embodiment of a sleeve-type barrel support arrangement suitable for use in the mounting facility of FIGS. 1 and 2.

An advantageous arrangement of the barrel support 11 is shown in FIG. 3.

An inner sleeve 13 is affixed to the outer periphery of the barrel 1. The sleeve 13, which is made relatively long, is provided with a pair of radially outwardly extending flanges 13.1, 13.2 at its outer ends.

An outer, relatively short second sleeve 121 is coaxial with and surrounds the inner sleeve 13, the sleeve 121 including a pair of radially inwardly extending flanges 11.2, 11.3 at its ends. The flanges 11.2, 11.3 are axially straddled by the flanges 13.1, 13.2 on the inner sleeve 13.

The flanges 11.2, 11.3 terminate radially inwardly in spaced relation to an outer surface 122 of the sleeve 13. The radial gap between the flanges 11.2, 11.3 and the underlying surface 122 is movably closed by an axially positionable guide member 14, which is adjustable between the front flange 13.1 and the rear flange 13.2 of the sleeve 13. A chamber 11.1 defined between the end flanges 11.2, 11.3 and an inner surface 123 of the outer sleeve 121 is closed on its radially inner end by the outer surface of the glide member 14.

In order to permit an accurate determination of the reaction forces set up in the barrel 1 when the gun 101 is fired in either of its cannon or mortar positions, the glide member 14 is provided with a radially outwardly extending abutment 14.2 which protrudes into the chamber 11.1 of the outer sleeve 121. In addition, a pair of springs represented schematically at 11.4, 11.5 individually extend axially between opposed axial ends of the abutment 14.2 and the inner surface of the adjacent one of the flanges 11.2, 11.3.

The arrangement just described is employed in the following way: When the gun 101 is in its mortar position, the gliding member 14 is positioned forwardly until it abuts the front flange 13.1 of the sleeve 13. The member 14 is maintained in such position by means of a clamping ring 14.1 which surrounds a portion of the glide member 14 externally of the chamber 11.1, such clamping ring 14.1 being selectively lockable by means of a handle 14.3. When the glide member 14 is in such forward position, the front spring 11.4 is compressed and the rear spring 11.5 is expanded; thus, when a mortar round is fired, the recoil of the barrel, and thereby the glide member 14 now locked thereto via the sleeve 13, will cause the abutment 14.2 to move rearwardly against the force of the spring 11.5. Since such movement and the spring constant are easily determined, an accurate measurement of the reaction forces can be obtained.

In like manner, when the gun 101 is levelled into its cannon position, the glide member 14 is locked in its rearmost position against the flange 13.2, thereby compressing the spring 11.5 and expanding the spring 11.4. In this case, when the gun 101 is fired, the forward movement of the barrel will cause the abutment 14.2 to compress the spring 11.4, so that the corresponding reaction forces can again be easily calculated.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a field gun having an elongated barrel adjustable between a relatively high elevation angle for use as a mortar and a relatively low elevation angle for use as a cannon, barrel support means coaxial with and surrounding an intermediate portion of the barrel, means supported at first and second spaced base points for adjustably positioning the barrel support means between the high and low elevation angles, mortar breech means affixed to the positioning means and associated with the first base point for removably engaging the rear end of the barrel in firing relation when the barrel is at its upper elevation angle, and cannon breech means interchangeable with the mortar breech means and pivotally carried at a rear portion of the barrel for oscillation in a plane containing the barrel axis between a first forward inoperative position out of engagement with the rear end of the barrel and a second rear operative position engaged in firing relation with the rear end of the barrel when the barrel is at its lower elevation angle.

2. A field gun as defined in claim 1, in which the positioning means comprises, in combination, a first support member having a lower end pivotally supported at the second base point for oscillation in a vertical plane, the upper end of the first support member having an axle separately supported for rotation in said plane, a rear support member having a lower end affixed to the mortar breech means, the second support member including telescoping means at its upper end for adjusting the distance between the upper end of the second support member and the lower end thereof, a bridge member having a front end affixed to the axle on the upper end of the first support member and a rear end pivotally connected to the upper end of the second support member, and means for connecting the barrel support means to an intermediate portion of the bridge member.

3. A field gun as defined in claim 2, further comprising an anchor plate affixed to the first base point, and means for pivotally connecting the mortar breech means to the anchor plate.

4. A field gun as defined in claim 1, in which the positioning means further comprises a trunion disposed in a horizontal plane for oscillating the barrel support means in a vertical plane.

5. A field gun as defined in claim 1, in which the operative and inoperative positions of the cannon breech mechanism are disposed 180° apart in the plane containing the barrel axis.

6. A field gun as defined in claim 1, in which the barrel support means comprises, in combination, a first sleeve coaxial with and radially spaced from the outer surface of the barrel, the first sleeve having front and rear radially inwardly extending flanges cooperating with the inner surface of the intervening surface of the first sleeve to define a chamber, a second sleeve coaxial with and affixed to the outer surface of the barrel and having front and rear radially outwardly extending flanges straddling the respective downwardly extending flanges of the first sleeve, the flanges on the outer sleeve terminating in spaced relation to the outer surface of the second sleeve to define a radial gap therebetween, and an elongated glide member adapted for sliding axial movement through said radial gap, the glide member having a radially outwardly extending abutment projecting into and captured within the chamber of the first sleeve.

7. A field gun as defined in claim 6, further comprising a pair of resilient spring means individually disposed between the respective axial ends of the abutment and the inner surfaces of the adjacent flanges of the first sleeve.

8. A field gun as defined in claim 6, further comprising a clamping ring surrounding a portion of the glide member exterior of the chamber in the first sleeve, and means for selectively clamping said ring against the underlying second sleeve.

* * * * *